US011293084B2

(12) United States Patent
Higami et al.

(10) Patent No.: US 11,293,084 B2
(45) Date of Patent: Apr. 5, 2022

(54) SHEET MATERTAL OF COPPER ALLOY AND METHOD FOR PRODUCING SAME

(71) Applicant: Dowa Metaltech Co., Ltd., Tokyo (JP)

(72) Inventors: Naota Higami, Tokyo (JP); Takanobu Sugimoto, Tokyo (JP); Tomotsugu Aoyama, Tokyo (JP); Hiroto Narieda, Tokyo (JP)

(73) Assignee: Dowa Metaltech Co., Ltd., Tokyo (JP)

( * ) Notice: Subject to any disclaimer, the term of this patent is extended or adjusted under 35 U.S.C. 154(b) by 163 days.

(21) Appl. No.: 16/345,298

(22) PCT Filed: Oct. 24, 2017

(86) PCT No.: PCT/JP2017/038243
§ 371 (c)(1),
(2) Date: Apr. 26, 2019

(87) PCT Pub. No.: WO2018/079507
PCT Pub. Date: May 3, 2018

(65) Prior Publication Data

US 2019/0264313 A1 Aug. 29, 2019

(30) Foreign Application Priority Data

Oct. 28, 2016 (JP) ..... JP2016-212103
Oct. 19, 2017 (JP) ..... JP2017-202320

(51) Int. Cl.
*C22F 1/08* (2006.01)
*C22C 9/04* (2006.01)
*C22C 9/00* (2006.01)
*H01B 1/02* (2006.01)

(52) U.S. Cl.
CPC ..... *C22F 1/08* (2013.01); *C22C 9/00* (2013.01); *C22C 9/04* (2013.01); *H01B 1/026* (2013.01)

(58) Field of Classification Search
CPC .. C22C 9/00; C22C 9/04; C22C 30/02; H01B 1/026; C22F 1/08; F05C 2201/0475; F05C 2201/0481; B63B 2231/12; B63B 2231/16; B23B 2222/12; B23B 2222/21; B23C 2222/12; B25D 2222/27; B25D 2222/33; C21D 8/0273; C21D 8/0236; C21D 1/84; C21D 2211/004
See application file for complete search history.

(56) References Cited

U.S. PATENT DOCUMENTS 4,362,579 A * 12/1982 Tsuji ..... H01H 1/025 148/681
2002/0057985 A1* 5/2002 Ling ..... C22F 1/08 420/476
2004/0234412 A1* 11/2004 Oishi ..... H01H 1/025 420/477
2014/0234156 A1* 8/2014 Uchida ..... C22C 9/04 420/471
2016/0186295 A1* 6/2016 Oishi ..... C21D 9/46 148/554
2016/0201164 A1* 7/2016 Oishi ..... C21D 8/0236 420/471
2016/0201180 A1* 7/2016 Oishi ..... C21D 8/0236 148/501
2016/0222489 A1* 8/2016 Oishi ..... C21D 8/0236

FOREIGN PATENT DOCUMENTS

CN 104073680 A * 10/2014
JP 2001164328 A 6/2001
JP 2002088428 A 3/2002
JP 2009062610 A 3/2009
WO WO-2014056466 A1 * 4/2014 ..... C22C 9/04
WO 2015046421 A 4/2015
WO WO-2015046470 A1 * 4/2015 ..... C21D 8/0226
WO 2017018487 A1 2/2017

OTHER PUBLICATIONS

International search report for Patent Application No. PCT/JP2017/038243 dated Dec. 27, 2017.

* cited by examiner

*Primary Examiner* — Anthony J Zimmer
*Assistant Examiner* — Dean Mazzola
(74) *Attorney, Agent, or Firm* — Bachman and Lapointe PC; George Coury

(57) ABSTRACT

An inexpensive sheet material of a copper alloy has excellent bending workability and excellent stress corrosion cracking resistance while maintaining high strength. The sheet material is produced by a method including melting and casting raw materials of a copper alloy which has a chemical composition having 17 to 32 wt. % of zinc, 0.1 to 4.5 wt. % of tin, 0.01 to 2.0 wt. % of silicon, 0.01 to 5.0 wt. % of nickel, and the balance being copper and unavoidable impurities; hot-rolling the cast copper alloy at 900° C. to 400° C.; cooling the hot-rolled copper alloy at 1 to 15° C./min. from 400° C. to 300° C.; cold-rolling the cooled copper alloy; recrystallization-annealing the cold-rolled copper alloy at 300 to 800° C.; and then, ageing-annealing the recrystallization-annealed copper alloy at 300 to 600° C.

12 Claims, No Drawings

SHEET MATERTAL OF COPPER ALLOY AND METHOD FOR PRODUCING SAME

TECHNICAL FIELD

The present invention generally relates to a sheet material of a copper alloy and a method for producing the same. More specifically, the invention relates to a sheet material of a copper alloy, such as a Cu—Zn—Sn alloy, which is used as the material of electric and electronic parts, such as connectors, lead frames, relays and switches, and a method for producing the same.

BACKGROUND ART

The materials used for electric and electronic parts, such as connectors, lead frames, relays and switches, are required to have a good electric conductivity in order to suppress the generation of Joule heat due to the carrying of current, as well as such a high strength that the materials can withstand the stress applied thereto during the assembly and operation of electric and electronic apparatuses using the parts. The materials used for electric and electronic parts, such as connectors, are also required to have an excellent bending workability since the parts are generally formed by bending. Moreover, in order to ensure the contact reliability between electric and electronic parts, such as connectors, the materials used for the parts are required to have an excellent stress relaxation resistance, i.e., a resistance to such a phenomenon (stress relaxation) that the contact pressure between the parts is deteriorated with age.

In recent years, there is a tendency for electric and electronic parts, such as connectors, to be integrated, miniaturized and lightened. In accordance therewith, the sheet materials of copper and copper alloys serving as the materials of the parts are required to be thinned, so that the required strength level of the materials is more severe. In accordance with the miniaturization and complicated shape of electric and electronic parts, such as connectors, it is required to improve the precision of shape and dimension of products manufactured by bending the sheet materials of copper alloys. In recent years, there is a tendency to proceed with the decrease of environmental load, saving resources and saving energy. In accordance therewith, the sheet materials of copper and copper alloys serving as the materials of the parts are increasingly required to decrease the raw material costs and production costs and to recycle the products thereof.

However, there are trade-off relationships between the strength and electric conductivity of a sheet material of a metal, between the strength and bending workability thereof and between the bending workability and stress relaxation resistance thereof, respectively, and conventionally, a relatively low-cost sheet material having a good electric conductivity, strength, bending workability or stress relaxation resistance is suitably chosen in accordance with the use thereof as a sheet material used for an electric and electronic part, such as a connector.

As conventional general-purpose materials for electric and electronic parts such as connectors, there are used brasses, phosphor bronzes and so forth. Phosphor bronzes have a relatively excellent balance between the strength, corrosion resistance, stress corrosion cracking resistance and stress relaxation resistance of a sheet material thereof. However, for example, in the case of the second-class phosphor bronze (C5191), it is not possible to carry out the hot rolling of a sheet material thereof, and it contains about 6% of expensive tin, so that the costs of the sheet material thereof are increased.

On the other hand, brasses (Cu—Zn copper alloys) are widely used as materials having low raw material costs and low production costs and having an excellent recycling efficiencies of products thereof. However, the strength of brasses is lower than that of phosphor bronzes. The temper designation of a brass having the highest strength is EH (H06). For example, the sheet product of the first-class brass (C2600-SH) generally has a tensile strength of about 550 MPa which is comparable with the tensile strength of the temper designation H (H04) of the second-class phosphor bronze. In addition, the sheet product of the first-class brass (C2600-SH) does not have an excellent stress corrosion cracking resistance.

In order to improve the strength of brasses, it is required to increase the finish rolling reduction (to increase the temper designation). In accordance therewith, the bending workability in directions perpendicular to the rolling directions (i.e., the bending workability in directions in which the bending axis extends in directions parallel to the rolling directions) is remarkably deteriorated. For that reason, even if a brass having a high strength level is used as the material, there are some cases where it is not possible to work the sheet material to produce an electric and electronic part such as a connector. For example, if the finish rolling reduction of a sheet material of the first-class brass is increased to cause the tensile strength to be higher than 570 MPa, it is difficult to press the sheet material to produce a small product.

In particular, in the case of a brass having a simple alloy of copper and zinc, it is not easy to improve the bending workability thereof while maintaining the strength thereof. For that reason, it is improved to enhance the strength level by adding various elements to brasses. For example, there are proposed copper-zinc alloys wherein a third element, such as tin, silicon and nickel, is added thereto (see, e.g., Patent Documents 1-3).

PRIOR ART DOCUMENTS(S)

Patent Document(s)

Patent Document 1: Japanese Patent Laid-Open No. 2001-164328 (Paragraph Number 0013)
Patent Document 2: Japanese Patent Laid-Open No. 2002-88428 (Paragraph Number 0014)
Patent Document 3: Japanese Patent Laid-Open No. 2009-62610 (Paragraph Number 0019)

SUMMARY OF THE INVENTION

Problem to be Solved by the Invention

However, even if tin, silicon, nickel or the like is added to a brass (a copper-zinc alloy), there are some cases where it is not possible to sufficiently improve the bending workability of a sheet material thereof.

It is therefore an object of the present invention to eliminate the aforementioned conventional problems and to provide an inexpensive sheet material of a copper alloy having an excellent bending workability and an excellent stress corrosion cracking resistance while maintaining a high strength, and a method for producing the same.

Means for Solving the Problem

In order to accomplish the aforementioned object, the inventors have diligently studied and found that it is possible to produce an inexpensive sheet material of a copper alloy having an excellent bending workability and an excellent stress corrosion cracking resistance while maintaining a high strength, if the sheet material of the copper alloy is produced by a method comprising the steps of: melting and casting raw materials of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities; hot-rolling the cast copper alloy in a temperature range of from 900° C. to 400° C.; cooling the hot-rolled copper alloy at a cooling rate of 1 to 15° C./minute from 400° C. to 300° C.; cold-rolling the cooled copper alloy; recrystallization-annealing the cold-rolled copper alloy at a temperature of 300 to 800° C.; and ageing-annealing the recrystallization-annealed copper alloy at a temperature of 300 to 600° C. Thus, the inventors have made the present invention.

According to the present invention, there is provided a method for producing a sheet material of a copper alloy, the method comprising the steps of: melting and casting raw materials of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities; hot-rolling the cast copper alloy in a temperature range of from 900° C. to 400° C.; cooling the hot-rolled copper alloy at a cooling rate of 1 to 15° C./minute from 400° C. to 300° C.; cold-rolling the cooled copper alloy; recrystallization-annealing the cold-rolled copper alloy at a temperature of 300 to 800° C.; and ageing-annealing the recrystallization-annealed copper alloy at a temperature of 300 to 600° C.

This method for producing a sheet material of a copper alloy preferably further comprises steps of: carrying out a finish cold-rolling after the step of ageing-annealing; and thereafter, carrying out a low-temperature annealing at a temperature of not higher than 450° C. Alternatively, the method for producing a sheet material of a copper alloy may further comprise a step of carrying out a cold rolling after the step of recrystallization annealing and before the step of ageing annealing. The chemical composition of the raw material of the copper alloy may further comprise one or more elements which are selected from the group consisting of iron, cobalt, chromium, magnesium, aluminum, boron, phosphorus, zirconium, titanium, manganese, gold, silver, lead, cadmium and beryllium, the total amount of these elements being 3% by weight or less.

According to the present invention, there is provided a sheet material of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities, wherein the time when cracks are observed in the sheet material is longer than ten times as long as that in a sheet material of a first-class brass (C2600-SH), while the sheet material, to which a bending stress corresponding to 80% of the 0.2% proof stress thereof is applied, is held in a desiccator containing 3% by weight of ammonia water. In this sheet material of a copper alloy, the number of coarse deposits, which have particle diameters of not less than 1 μm, per a unit area on the surface of the sheet material of the copper alloy is preferably not more than 15000/mm$^2$.

According to the present invention, there is provided a sheet material of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities, wherein the number of coarse deposits, which have particle diameters of not less than 1 μm, per a unit area on the surface of the sheet material of the copper alloy is not more than 15000/mm$^2$.

The above-described sheet material of the copper alloy preferably has a tensile strength of not lower than 550 MPa, and a 0.2% proof stress of not lower than 500 MPa. The sheet material of the copper alloy preferably has an electric conductivity of not lower than 10% IACS. The chemical composition of the sheet material of the copper alloy may further comprise one or more elements which are selected from the group consisting of iron, cobalt, chromium, magnesium, aluminum, boron, phosphorus, zirconium, titanium, manganese, gold, silver, lead, cadmium and beryllium, the total amount of these elements being 3% by weight or less. The mean crystal grain size on the surface of the sheet material of the copper alloy is preferably not greater than 10 μm.

According to the present invention, there is provided a connecter terminal, the material of which is the above-described sheet material of the copper alloy.

Effects of the Invention

According to the present invention, it is possible to produce an inexpensive sheet material of a copper alloy having an excellent bending workability and an excellent stress corrosion cracking resistance while maintaining a high strength.

MODE FOR CARRYING OUT THE INVENTION

The preferred embodiment of a method for producing a sheet material of a copper alloy according to the present invention, comprises: a melting/casting step for melting and casting raw materials of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities; a hot rolling step of hot-rolling the cast copper alloy in a temperature range of from 900° C. to 400° C. after the melting/casting step, and then, cooling the hot-rolled copper alloy at a cooling rate of 1 to 15° C./minute from 400° C. to 300° C.; a cold rolling step of cold-rolling the cooled copper alloy after the hot rolling step; a recrystallization annealing step of recrystallization-annealing the cold-rolled copper alloy at a temperature of 300 to 800° C. after the cold rolling step; and an ageing annealing step of annealing the recrystallization-annealed copper alloy at a temperature of 300 to 600° C. after the recrystallization-annealing step. The method may further comprise a finish cold rolling step of finish-cold-rolling the recrystallization-annealed copper alloy after the ageing-annealing step, and a low-temperature annealing step of carrying out a low-temperature annealing at a temperature of not higher than 450° C. after the finish cold rolling step. These steps will be described below in detail. Furthermore, facing may be optionally carried out after the hot rolling step. After each heat treatment, pickling, polishing, degreasing and so forth may be optionally carried out.

(Melting and Casting Step)

After the raw materials of a copper alloy are melted by a usual method for ingoting a brass, an ingot is produced by the continuous casting, semi-continuous casting or the like. Furthermore, when the raw materials may be melted in the atmosphere.

(Hot Rolling Step)

The hot rolling of a copper-zinc alloy is usually carried out in a high temperature range of not lower than 650° C. or 700° C. in order to cause the destruction of the cast structure and the softening of the materials by recrystallization during the rolling and between the rolling paths. However, if the hot rolling is carried out at a high temperature of higher than 900° C., there is some possibility that cracks may be produced in portions, such as the segregated portions of alloy components, in which the melting point thereof is lowered, so that the hot rolling is not preferably carried out at such a high temperature. For that reason, the average cooling rate is 1 to 15° C./minute from 400° C. to 300° C. when the copper-zinc alloy is cooled after the hot rolling thereof is carried out in a temperature range of from 900° C. to 400° C.

(Cold Rolling Step)

At the cold rolling step, the rolling reduction is preferably not less than 50%, more preferably not less than 80%, and most preferably not less than 90%. Furthermore, this cold rolling may be repeatedly carried out while carrying out an intermediate annealing at a temperature of 300 to 650° C. between the cold rolling paths thereof.

(Recrystallization Annealing Step)

At the recrystallization annealing step, annealing is carried out a temperature of 300 to 800° C. At this intermediate annealing step, a heat treatment is preferably carried out by setting the holding time and attainment temperature at a temperature of 300 to 800° C. so that the mean crystal grain size after the annealing is not greater than 10 μm (preferably not greater than 9 μm). Furthermore, the particle diameters of recrystallized grains obtained by this annealing are varied in accordance with the rolling reduction in the cold rolling before the annealing and in accordance with the chemical composition thereof. However, if the relationship between the annealing heat pattern and the mean crystal grain size is previously obtained by experiments with respect to each of various alloys, it is possible to set the holding time and attainment temperature at a temperature of 300 to 800° C. Specifically, in the case of the chemical composition of the sheet material of the copper alloy according to the present invention, it is possible to set appropriate conditions in heating conditions for holding at a temperature of 300 to 800° C. (preferably 450 to 800° C., more preferably 500 to 800° C., and most preferably 575 to 800° C.) for a few seconds to a few hours.

(Ageing Annealing Step)

At this ageing annealing step, annealing is carried out at a temperature of 300 to 600° C. (preferably 350 to 550° C.). The ageing annealing temperature is preferably lower than the recrystallization annealing temperature. Furthermore, after carrying out the recrystallization annealing and before carrying out the ageing annealing, a cold rolling may be carried out. In this case, it is not required to carry out the finish cold rolling and the low-temperature annealing.

(Finish Cold Rolling Step)

The finish cold rolling is carried out in order to improve the strength level of the sheet material of the copper alloy. If the rolling reduction in the finish cold rolling is too low, the strength of the sheet material of the copper alloy is decreased. On the other hand, if the rolling reduction in the finish cold rolling is too high, it is not possible to obtain a crystal orientation wherein both of the strength and bending workability are improved. For that reason, the rolling reduction in the finish cold rolling is preferably 1 to 40% and more preferably 3 to 35%.

(Low-Temperature Annealing Step)

After carrying out the finish cold rolling, the low-temperature annealing may be carried out in order to improve the stress corrosion cracking resistance and bending workability of the sheet material of the copper alloy due to the decrease of the residual stress of the sheet material of the copper alloy and in order to improve the stress relaxation resistance of the sheet material of the copper alloy due to the decrease of dislocation in vacancies and on the slip plane. By this low-temperature annealing, it is possible to improve all of the strength, stress corrosion cracking resistance, bending workability and stress relaxation resistance of the sheet material of the copper alloy, and it is also possible to enhance the electric conductivity thereof. If the heating temperature is too high, the sheet material of the copper alloy is softened in a short period of time, so that variations in characteristics are easily caused in either of batch and continuous systems. For that reason, at this low-temperature annealing step, annealing is carried out at a temperature of not higher than 450° C. (preferably not higher than 300 to 450° C.).

By the above-described preferred embodiment of a method for producing a sheet material of a copper alloy according to the present invention, it is possible to produce the preferred embodiment of a sheet material of a copper alloy according to the present invention.

The preferred embodiment of a sheet material of a copper alloy according to the present invention has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities. In this sheet material of the copper alloy, the time when cracks are observed in the sheet material of the copper alloy is longer than ten times as long as that in a sheet material of a first-class brass (C2600-SH), while the sheet material of the copper alloy to which a bending stress corresponding to 80% of the 0.2% proof stress of the sheet material is applied is held at 25° C. in a desiccator containing 3% by weight of ammonia water.

The preferred embodiment of a sheet material of a copper alloy according to the present invention is a sheet material of a Cu—Zn—Sn—Si—Ni alloy wherein tin, silicon and nickel are added to a Cu—Zn alloy containing copper and zinc.

Zinc has the function of improving the strength and spring property of the sheet material of the copper alloy. Since zinc is cheaper than copper, a large amount of zinc is preferably added to the copper alloy. However, if the content of zinc exceeds 32% by weight, beta (β) phase is generated to remarkably lower the cold workability of the sheet material of the copper alloy and the stress corrosion cracking resistance thereof, and to lower the plating and soldering properties thereof due to moisture and heating. On the other hand, if the content of zinc is less than 17% by weight, the strength, such as 0.2% proof stress and tensile strength, and spring property of the sheet material of the copper alloy are insufficient, and the Young's modulus thereof is increased. In addition, the amount of hydrogen gas absorption is increased during the melting of the sheet material of the copper alloy, and blowholes are easily generated in the ingot of the copper alloy. Moreover, the amount of inexpensive zinc is small in the sheet material of the copper alloy, so that the costs thereof is increased. Therefore, the content of zinc is preferably 17 to 32% by weight, and more preferably 18 to 31% by weight.

Tin has the function of improving the strength, stress relaxation resistance and stress corrosion cracking resistance of the sheet material of the copper alloy. In order to reuse the materials, which are surface-treated with tin, such as tin-plated materials, the sheet material of the copper alloy preferably contains tin. However, if the content of tin in the sheet material of the copper alloy exceeds 4.5% by weight, the electric conductivity of the sheet material of the copper alloy is suddenly lowered, and the segregation in the grain boundaries of the copper alloy is violently increased in the presence of zinc, so that the hot workability of the sheet material of the copper alloy is remarkably lowered. On the other hand, if the content of tin is less than 0.1% by weight, the function of improving the mechanical characteristics of the sheet material of the copper alloy is decreased, and it is difficult to use pressed scraps and so forth, which are plated with tin, as the raw materials of the sheet material of the copper alloy. Therefore, if the sheet material of the copper alloy contains tin, the content of tin is preferably 0.1 to 4.5% by weight, and more preferably 0.2 to 2.5% by weight.

Silicon has the function of improving the stress corrosion cracking resistance of the sheet material of the copper alloy even if the content of silicon therein is small. In order to sufficiently obtain this function, the content of silicon is preferably not less than 0.01% by weight. However, if the content of silicon exceeds 2.0% by weight, the electric conductivity of the sheet material of the copper alloy is easily lowered. In addition, silicon is an easily oxidized element to easily lower the castability of the copper alloy, so that the content of silicon is preferably not too large. Therefore, if the sheet material of the copper alloy contains silicon, the content of silicon is preferably 0.01 to 2.0% by weight, and more preferably 0.1 to 1.5% by weight. Moreover, silicon forms a compound with nickel to be dispersed to precipitate to improve the electric conductivity, strength, spring limit value and stress relaxation resistance of the sheet material of the copper alloy.

Nickel has the function of carrying out the solid-solution strengthening (or hardening) of the sheet material of the copper alloy and of improving the stress relaxation resistance thereof. In particular, the equivalent of nickel to zinc is a minus value to suppress the generation of beta (β) phase, so that silicon has the function of suppressing variation in characteristics during mass production. In order to sufficiently obtain such functions, the content of nickel is preferably not less than 0.01% by weight. On the other hand, if the content of nickel exceeds 5.0% by weight, the electric conductivity of the sheet material of the copper alloy is remarkably lowered. Therefore, if the sheet material of the copper alloy contains nickel, the content of nickel is preferably 0.01 to 5.0% by weight, and more preferably 0.1 to 4.5% by weight.

The sheet material of the copper alloy may have a chemical composition further comprising one or more elements which are selected from the group consisting of iron, cobalt, chromium, magnesium, aluminum, boron, phosphorus, zirconium, titanium, manganese, gold, silver, lead, cadmium and beryllium, the total amount of these elements being 3% by weight (preferably 1% by weight, more preferably 0.5% by weight) or less.

The mean crystal grain size of the sheet material of the copper alloy is preferably not greater than 10 μm, more preferably 1 to 9 μm, and most preferably 2 to 8 μm, since the bending workability of the sheet material of the copper alloy is advantageously improved as it is small.

The tensile strength of the sheet material of the copper alloy is preferably not lower than 550 MPa, more preferably not lower than 600 MPa, and most preferably 640 MPa, in order to produce miniaturized and thinned electric and electronic parts, such as connectors. In addition, the 0.2% proof stress of the sheet material of the copper alloy is preferably not lower than 500 MPa, more preferably not lower than 550 MPa, and most preferably not lower than 580 MPa.

The electric conductivity of the sheet material of the copper alloy is preferably not lower than 10% IACS, and more preferably not lower than 15% IACS.

In order to evaluate the stress corrosion cracking resistance of the sheet material of the copper alloy, a bending stress corresponding to 80% of the 0.2% proof stress thereof is applied to a test piece which is cut out from the sheet material of the copper alloy, and the test piece is held at 25° C. in a desiccator containing 3% by weight of ammonia water. With respect to the test piece taken out every one hour, the time when cracks are observed in the sheet material of the copper alloy at a magnification of 100 by means of an optical microscope is preferably not shorter than 50 hours, and more preferably not shorter than 60 hours. This time is preferably longer than ten times (more preferably longer than twelve times) as long as that in a sheet material of a commercially-available first-class brass (C2600-SH).

In order to evaluate the bending workability of the sheet material of the copper alloy, a bending test piece is cut out from the sheet material of the copper alloy so that the longitudinal direction of the bending test piece is a direction TD (a direction perpendicular to the rolling and thickness directions of the sheet material of the copper alloy). When the 90° W bending test of the bending test piece is carried out so that the bending axis of the bending test piece is a direction LD (the rolling direction of the sheet material of the copper alloy), the ratio R/t of the minimum bending radius R to the thickness t of the bending test piece in the 90° W bending test is preferably not higher than 1.0, more preferably not higher than 0.7, and most preferably not higher than 0.6.

The number of coarse deposits (having particle diameters of not less than 1 μm) per a unit area on the surface of the sheet material of the copper alloy is preferably not more than 15000/mm$^2$ and more preferably not more than 12000/mm$^2$. If the formation of the coarse deposits of nickel and silicon is thus suppressed to form the fine deposits of nickel and silicon, it is possible to produce a sheet material of a copper alloy having an excellent bending workability and an excellent stress corrosion cracking resistance while maintaining a high strength.

EXAMPLES

The examples of a sheet material of a copper alloy and a method for producing the same according to the present invention will be described below in detail.

Examples 1-16 and Comparative Examples 1-8

There were melted a copper alloy containing 19.7% by weight of zinc, 0.77% by weight of tin, 1.05% by weight of silicon, 3.85% by weight of nickel and the balance being copper (Example 1), a copper alloy containing 20.9% by weight of zinc, 0.79% by weight of tin, 0.95% by weight of silicon, 2.81% by weight of nickel and the balance being copper (Example 2), a copper alloy containing 20.5% by weight of zinc, 0.71% by weight of tin, 0.98% by weight of silicon, 1.24% by weight of nickel and the balance being copper (Example 3), a copper alloy containing 22.1% by weight of zinc, 0.79% by weight of tin, 0.47% by weight of silicon, 2.63% by weight of nickel and the balance being copper (Example 4), a copper alloy containing 19.9% by weight of zinc, 0.76% by weight of tin, 0.46% by weight of silicon, 1.67% by weight of nickel and the balance being copper (Example 5), a copper alloy containing 20.2% by weight of zinc, 0.77% by weight of tin, 0.46% by weight of silicon, 0.96% by weight of nickel and the balance being copper (Example 6), a copper alloy containing 19.8% by weight of zinc, 0.75% by weight of tin, 0.49% by weight of silicon, 0.45% by weight of nickel and the balance being copper (Example 7), a copper alloy containing 1.98% by weight of zinc, 0.25% by weight of tin, 1.01% by weight of silicon, 3.82% by weight of nickel and the balance being copper (Example 8), a copper alloy containing 21.1% by weight of zinc, 2.08% by weight of tin, 0.50% by weight of silicon, 1.89% by weight of nickel and the balance being copper (Example 9), a copper alloy containing 30.1% by weight of zinc, 0.75% by weight of tin, 0.50% by weight of silicon, 1.78% by weight of nickel and the balance being copper (Example 10), a copper alloy containing 20.0% by weight of zinc, 0.77% by weight of tin, 1.00% by weight of silicon, 3.75% by weight of nickel and the balance being copper (Example 11), a copper alloy containing 20.1% by weight of zinc, 0.72% by weight of tin, 1.00% by weight of silicon, 3.91% by weight of nickel and the balance being copper (Example 12), a copper alloy containing 22.0% by weight of zinc, 0.77% by weight of tin, 0.49% by weight of silicon, 2.00% by weight of nickel, 0.15% by weight of iron, 0.08% by weight of cobalt, 0.07% by weight of chromium and the balance being copper (Example 13), a copper alloy containing 23.2% by weight of zinc, 0.78% by weight of tin, 0.50% by weight of silicon, 2.01% by weight of nickel, 0.08% by weight of magnesium, 0.08% by weight of aluminum, 0.10% by weight of zirconium, 0.10% by weight of titanium and the balance being copper (Example 14), a copper alloy containing 22.5% by weight of zinc, 0.80% by weight of tin, 0.49% by weight of silicon, 1.90% by weight of nickel, 0.05% by weight of boron, 0.05% by weight of phosphorus, 0.08% by weight of manganese, 0.10% by weight of beryllium and the balance being copper (Example 15), a copper alloy containing 21.5% by weight of zinc, 0.78% by weight of tin, 0.50% by weight of silicon, 1.85% by weight of nickel, 0.05% by weight of gold, 0.08% by weight of silver, 0.08% by weight of lead, 0.07% by weight of cadmium and the balance being copper (Example 16), a copper alloy containing 24.5% by weight of zinc, 0.77% by weight of tin and the balance being copper (Comparative Examples 1-2), a copper alloy containing 24.5% by weight of zinc, 0.77% by weight of tin, 0.50% by weight of silicon, 1.99% by weight of nickel and the balance being copper (Comparative Examples 3-4), a copper alloy containing 24.5% by weight of zinc, 0.77% by weight of tin, 1.89% by weight of nickel, 0.02% by weight of phosphorus and the balance being copper (Comparative Example 5), a copper alloy containing 24.0% by weight of zinc, 0.77% by weight of tin, 1.97% by weight of nickel and the balance being copper (Comparative Example 6), and a copper alloy containing 19.8% by weight of zinc, 0.75% by weight of tin, 0.49% by weight of silicon, 0.45% by weight of nickel and the balance being copper (Comparative Examples 7-8), respectively. Then, the melted copper alloys were cast to obtain ingots, and cast pieces having a size of 40 mm×40 mm×20 mm were cut out from the ingots, respectively.

After each of the cast pieces was heated at 800° C. for 30 minutes, it was hot-rolled in a temperature range of 800° C. to 400° C. so as to have a thickness of 10 mm (rolling reduction=50%), and then, cooled from 400° C. to a room temperature. The cooling between 400° C. and 300° C. was carried out at an average cooling rate of 5° C./min. (Examples, 1, 3, 4, 6, 7, 9-13, 15, 16 and Comparative Examples 5-6), 10° C./min. (Example 2), 2° C./min. (Examples 5, 8 and 14), 20° C./min. (Comparative Examples 4 and 8), respectively, and by rapidly water-cooling each of the cast pieces (Comparative Examples 1-3 and 7).

Then, the cold rolling of each of the pieces was carried out so as to have a thickness of 0.26 mm (Examples 1, 2, 9 and Comparative Example 3), 0.28 mm (Examples 3-5, 8, 10, 13-16 and Comparative Example 4), 0.4 mm (Examples 6-7 and Comparative Examples 7-8), 0.38 mm (Example 11, Comparative Examples 1, 2, 5 and 6), 0.30 mm (Example 12), respectively. Furthermore, in Comparative Examples 1, 5 and 6, two cold rolling operations were carried out, and an intermediate annealing for holding each of the pieces at 550° C., 625° C. and 550° C., respectively, was carried out between the two cold rolling operations.

Then, there was carried out an intermediate annealing (recrystallization annealing) for holding each of the pieces at 800° C. for 10 minutes (Examples 1, 11 and 12), at 750° C. for 10 minutes (Examples 2-5, 10, 13-16 and Comparative Examples 3-4), at 600° C. for 10 minutes (Examples 6-7 and Comparative Examples 7-8), at 700° C. for 30 minutes (Examples 8 and 9), at 550° C. for 30 minutes (Comparative Examples 1 and 6), at 525° C. for 30 minutes (Comparative Example 2), and at 600° C. for 30 minutes (Comparative Example 5), respectively. Thereafter, in Examples 6-7 and Comparative Examples 7-8, each of the pieces was cold-rolled so as to have a thickness of 0.25 mm.

Then, in Examples 1-16, Comparative Examples 3-4 and 7-8, there was carried out an ageing annealing for holding each of the pieces at 425° C. for 3 hours (Examples 1-5, 10-11, 13-15 and Comparative Examples 3-4), at 450° C. for 30 minutes (Examples 6-7 and Comparative Examples 7-8), at 500° C. for 3 hours (Example 8), at 350° C. for 3 hours (Example 9) and at 550° C. for 3 hours (Example 12), respectively.

Then, in Examples 1-5, 8-16 and Comparative Examples 1-6, the pieces were finish cold-rolled at a rolling reduction of 5% (Examples 1, 2, 9 and Comparative Example 3), 11% (Examples 3-5, 8, 10, 13-16 and Comparative Example 4), 33% (Example 11, Comparative Examples 1-2 and 5-6), 16% (Example 12), respectively. Then, there was carried out a low temperature annealing for holding each of the pieces at 350° C. for 30 minutes (Examples 1-5, 8-16 and Comparative Examples 3-5) and at 300° C. for 30 minutes (Comparative Examples 1-2 and 6), respectively.

Then, samples were cut out from the sheet materials of the copper alloys thus obtained in Examples 1-16 and Comparative Examples 1-8, and the mean crystal grain size of the crystal grain structure, electric conductivity, tensile strength, stress corrosion cracking resistance and bending workability thereof were examined as follows.

The mean crystal grain size of crystal grain structure of the sheet material of the copper alloy was measured by the method of section based on JIS H0501 by observing the surface (rolled surface) of the sheet material of the copper alloy by means of an optical microscope after the surface was polished and etched. As a result, the mean crystal grain size was 5 μm (Examples 1, 3-5, 7, 12, Comparative Examples 1-2 and 7-8), 4 μm (Examples 2, 10, 11, 13-16 and Comparative Examples 3-6), 6 μm (Example 3), 3 μm (Examples 8 and 9), respectively.

The electric conductivity of the sheet material of the copper alloy was measured in accordance with the electric conductivity measuring method based on JIS H0505. As a result, the electric conductivity of the sheet material of the copper alloy was 21.7% IACS (Example 1), 20.6% IACS (Example 2), 16.4% IACS (Example 3), 23.9% IACS (Example 4), 23.6% IACS (Example 5), 20.6% IACS (Example 6), 19.5% IACS (Example 7), 27.9% IACS (Example 8), 18.5% IACS (Example 9), 19.2% IACS (Example 10), 22.0% IACS (Example 11), 21.7% IACS (Example 12), 23.4% IACS (Example 13), 23.5% IACS (Example 14), 24.0% IACS (Example 15), 22.1% IACS (Example 16), 25.3% IACS (Comparative Example 1), 24.8% IACS (Comparative Example 2), 19.5% IACS (Comparative Example 3), 21.6% IACS (Comparative Example 4), 18.2% IACS (Comparative Example 5), 16.2% IACS (Comparative Example 6), 19.5% IACS (Comparative Example 7), 19.5% IACS (Comparative Example 8), respectively.

In order to evaluate the tensile strength serving as one of mechanical characteristics of the sheet material of the copper alloy, three test pieces (No. 5 test pieces based on JIS Z2201) for tension test in the direction LD (rolling direction) were cut out from each of the sheet materials of copper alloys. Then, the tension test based on JIS Z2241 was carried out with respect to each of the test pieces to derive the mean value of tensile strengths in the direction LD and the mean value of 0.2% proof stresses. As a result, the 0.2% proof stress and tensile strength in the direction LD were 589 MPa and 677 MPa (Example 1), 554 MPa and 637 MPa (Example 2), 587 MPa and 652 MPa (Example 3), 587 MPa and 676 MPa (Example 4), 601 MPa and 664 MPa (Example 5), 633 MPa and 682 MPa (Example 6), 630 MPa and 680 MPa (Example 7), 590 MPa and 655 MPa (Example 8), 590 MPa and 685 MPa (Example 9), 585 MPa and 644 MPa (Example 10), 660 MPa and 735 MPa (Example 11), 583 MPa and 677 MPa (Example 12), 601 MPa and 651 MPa (Example 13), 593 MPa and 655 MPa (Example 14), 600 MPa and 653 MPa (Example 15), 595 MPa and 658 MPa (Example 16), 593 MPa and 659 MPa (Comparative Example 1), 589 MPa and 660 MPa (Comparative Example 2), 583 MPa and 650 MPa (Comparative Example 3), 583 MPa and 650 MPa (Comparative Example 4), 596 MPa and 652 MPa (Comparative Example 5), 584 MPa and 642 MPa (Comparative Example 6), 625 MPa and 675 MPa (Comparative Example 7), 623 MPa and 678 MPa (Comparative Example 8), respectively.

In order to evaluate the stress corrosion cracking resistance of the sheet material of the copper alloy, a test piece having a width of 10 mm cut out from the sheet material of the copper alloy was bent in the form of an arch so that the surface stress in the central portion of the test piece in the longitudinal direction thereof was 80% of the 0.2% yield stress thereof. In this state, the test piece was held at 25° C. in a desiccator containing 3% by weight of ammonia water. With respect to the test piece (having the width of 10 mm) taken out every one hour, cracks were observed at a magnification of 100 by means of an optical microscope. As a result, cracks were observed after 75 hours (Example 1), 76 hours (Example 2), 89 hours (Example 3), 64 hours (Example 4), 67 hours (Example 5), 80 hours (Example 6), 75 hours (Example 7), 75 hours (Example 8), 128 hours (Example 9), 87 hours (Example 10), 65 hours (Example 11), 66 hours (Example 12), 75 hours (Example 13), 74 hours (Example 14), 72 hours (Example 15), 75 hours (Example 16), 24 hours (Comparative Example 1), 25 hours (Comparative Example 2), 39 hours (Comparative Example 3), 37 hours (Comparative Example 4), 30 hours (Comparative Example 5), 25 hours (Comparative Example 6), 30 hours (Comparative Example 7), 24 hours (Comparative Example 8), respectively. The time when cracks were observed in the sheet material of the copper alloy was 15 times (Example 1), 15 times (Example 2), 18 times (Example 3), 13 times (Example 4), 13 times (Example 5), 16 times (Example 6), 15 times (Example 7), 15 times (Example 8), 26 times (Example 9), 17 times (Example 10), 13 times (Example 11), 13 times (Example 12), 15 times (Example 13), 15 times (Example 14), 14 times (Example 15), 15 times (Example 16), 5 times (Comparative Example 1), 5 times (Comparative Example 2), 8 times (Comparative Example 3), 7 times (Comparative Example 4), 6 times (Comparative Example 5), 5 times (Comparative Example 6), 6 times (Comparative Example 7), 5 times (Comparative Example 8), respectively, as long as that in a sheet material of a commercially-available first-class brass (C2600-SH).

In order to evaluate the bending workability of the sheet material of the copper alloy, a bending test piece (width=10 mm) was cut out from the sheet material of the copper alloy so that the longitudinal direction of the bending test piece was a direction TD (a direction perpendicular to the rolling and thickness directions of the sheet material of the copper alloy). Then, with respect to the bending test piece, the 90° W bending test based on JIS H3110 was carried out so that the bending axis of the bending test piece was a direction LD (the rolling direction of the sheet material of the copper alloy) (Bad Way bending (B.W. bending)). With respect to the bending piece after this test, the surface and cross-section of the bent portion thereof was observed at a magnification of 100 by means of an optical microscope to obtain a minimum bending radius R wherein cracks were not observed. Then, the minimum bending radius R was divided by the thickness t to derive the ratio R/t. As a result, the ratio R/t was 0.4 (Examples 1, 2 and 6-8), 0.6 (Examples 3-5 and 9-16), 0.8 (Comparative Examples 1-8), respectively.

With respect to samples cut out from the sheet materials of the copper alloys in Examples 1-16, Comparative Examples 3-4 and 7-8, there was examined the number of coarse deposits (having a particle diameter (the diameter of the minimum circle surrounding each of the deposits) of not less than 1 μm) (per a unit area) on the surface of each of the samples. The number of the coarse deposits on the surface of the sheet material of the copper alloy was obtained as follows. First, each of the samples and a stainless plate were used as an anode and a cathode, respectively, for turning electricity on at a voltage of 15 V for 30 seconds in a solution containing 20% by weight of phosphoric acid to electrolytic-polish the sample. Then, a scanning electronic microscope was used for observing the secondary-electron image of the deposits on the surface of the sample at a magnification of 3000 to count the number of the coarse deposits. As a result, the number of the coarse deposits on the surface of the sheet material of the copper alloy was 7700/mm$^2$ (Example 1), 5000/mm$^2$ (Example 2), 2100/mm$^2$ (Example 3), 7800/mm$^2$ (Example 4), 8800/mm$^2$ (Example 5), 600/mm$^2$ (Example 6), 600/mm$^2$ (Example 7), 7500/mm$^2$ (Example 8), 7000/mm$^2$ (Example 9), 7600/mm$^2$ (Example 10), 7700/mm$^2$ (Example 11), 11000/mm$^2$ (Example 12), 7200/mm$^2$ (Example 13), 6900/mm$^2$ (Example 14), 8000/mm$^2$ (Example 15), 7800/mm$^2$ (Example 16), 20600/mm$^2$ (Comparative Example 3), 21000/mm$^2$ (Comparative Example 4), 16000/mm$^2$ (Comparative Example 7), 17800/mm$^2$ (Comparative Example 8), respectively.

The producing conditions and characteristics in these examples and comparative examples are shown in Tables 1 through 3.

TABLE 1

| | Chemical Composition (% by weight) | | | | | |
|---|---|---|---|---|---|---|
| | Cu | Zn | Sn | Si | Ni | other elements |
| Ex. 1 | bal. | 19.7 | 0.77 | 1.05 | 3.85 | — |
| Ex. 2 | bal. | 20.9 | 0.79 | 0.95 | 2.81 | — |
| Ex. 3 | bal. | 20.5 | 0.71 | 0.98 | 1.24 | — |
| Ex. 4 | bal. | 22.1 | 0.79 | 0.47 | 2.63 | — |
| Ex. 5 | bal. | 19.9 | 0.76 | 0.46 | 1.67 | — |
| Ex. 6 | bal. | 20.2 | 0.77 | 0.46 | 0.96 | — |
| Ex. 7 | bal. | 19.8 | 0.75 | 0.49 | 0.45 | — |
| Ex. 8 | bal. | 19.8 | 0.25 | 1.01 | 3.82 | — |
| Ex. 9 | bal. | 21.1 | 2.08 | 0.50 | 1.89 | — |
| Ex. 10 | bal. | 30.1 | 0.75 | 0.50 | 1.78 | — |
| Ex. 11 | bal. | 20.0 | 0.77 | 1.00 | 3.75 | — |
| Ex. 12 | bal. | 20.1 | 0.72 | 1.00 | 3.91 | — |

TABLE 1-continued

| | Chemical Composition (% by weight) | | | | | |
|---|---|---|---|---|---|---|
| | Cu | Zn | Sn | Si | Ni | other elements |
| Ex. 13 | bal. | 22.0 | 0.77 | 0.49 | 2.00 | Fe0.15, Co0.08 Cr0.07 |
| Ex. 14 | bal. | 23.2 | 0.78 | 0.50 | 2.01 | Mg0.08, Al0.08 Zr0.10, Ti0.10 |
| Ex. 15 | bal. | 22.5 | 0.80 | 0.49 | 1.90 | B0.05, P0.05 Mn0.08, Be0.10 |
| Ex. 16 | bal. | 21.5 | 0.78 | 0.50 | 1.85 | Au0.05, Ag0.08 Pb0.08, Cd0.07 |
| Comp. 1 | bal. | 24.5 | 0.77 | 0 | 0 | — |
| Comp. 2 | bal. | 24.5 | 0.77 | 0 | 0 | — |
| Comp. 3 | bal. | 24.5 | 0.77 | 0.50 | 1.99 | — |
| Comp. 4 | bal. | 24.5 | 0.77 | 0.50 | 1.99 | — |
| Comp. 5 | bal. | 24.5 | 0.77 | 0 | 1.89 | P0.02 |
| Comp. 6 | bal. | 24.0 | 0.77 | 0 | 1.97 | — |
| Comp. 7 | bal. | 19.8 | 0.75 | 0.49 | 0.45 | — |
| Comp. 8 | bal. | 19.8 | 0.75 | 0.49 | 0.45 | — |

TABLE 2

| | Cooling Rate (° C./min) after Hot Rolling | Thickness (mm) of Sheet before Recrystallization Annealing | Recrystallization (° C. × min.) | Ageing Annealing (° C. × hour) | Rolling Reduction (%) in Finish Cold Rolling | Temp. (° C.) in Low Temp. Annealing |
|---|---|---|---|---|---|---|
| Ex. 1 | 5 | 0.26 | 800 × 10 | 425 × 3 | 5 | 350 |
| Ex. 2 | 10 | 0.26 | 750 × 10 | 425 × 3 | 5 | 350 |
| Ex. 3 | 5 | 0.28 | 750 × 10 | 425 × 3 | 11 | 350 |
| Ex. 4 | 5 | 0.28 | 750 × 10 | 425 × 3 | 11 | 350 |
| Ex. 5 | 2 | 0.28 | 750 × 10 | 425 × 3 | 11 | 350 |
| Ex. 6 | 5 | 0.4 | 600 × 10 | 450 × 0.5 | — | — |
| Ex. 7 | 5 | 0.4 | 600 × 10 | 450 × 0.5 | — | — |
| Ex. 8 | 2 | 0.28 | 700 × 30 | 500 × 3 | 11 | 350 |
| Ex. 9 | 5 | 0.26 | 700 × 30 | 350 × 3 | 5 | 350 |
| Ex. 10 | 5 | 0.28 | 750 × 10 | 425 × 3 | 11 | 350 |
| Ex. 11 | 5 | 0.38 | 800 × 10 | 425 × 3 | 33 | 350 |
| Ex. 12 | 5 | 0.30 | 800 × 10 | 550 × 3 | 16 | 350 |
| Ex. 13 | 5 | 0.28 | 750 × 10 | 425 × 3 | 11 | 350 |
| Ex. 14 | 2 | 0.28 | 750 × 10 | 425 × 3 | 11 | 350 |
| Ex. 15 | 5 | 0.28 | 750 × 10 | 425 × 3 | 11 | 350 |
| Ex. 16 | 5 | 0.28 | 750 × 10 | 425 × 3 | 11 | 350 |
| Comp. 1 | RWC | 0.38 | 550 × 30 | — | 33 | 300 |
| Comp. 2 | RWC | 0.38 | 525 × 30 | — | 33 | 300 |
| Comp. 3 | RWC | 0.26 | 750 × 10 | 425 × 3 | 5 | 350 |
| Comp. 4 | 20 | 0.28 | 750 × 10 | 425 × 3 | 11 | 350 |
| Comp. 5 | 5 | 0.38 | 600 × 30 | — | 33 | 350 |
| Comp. 6 | 5 | 0.38 | 550 × 30 | — | 33 | 300 |
| Comp. 7 | RWC | 0.4 | 600 × 10 | 450 × 0.5 | — | — |
| Comp. 8 | 20 | 0.4 | 600 × 10 | 450 × 0.5 | — | — |

* RWC: Rapid Water Cooling

TABLE 3

| | Conductivity (% IACS) | Tensile Strength (MPa) | 0.2% Proof Stress (MPa) | Bending Workability (R/t) | Stress Corrosion Cracking Resistance Time (h) | Stress Corrosion Cracking Resistance Ratio to 2600 | Number of Coarse Deposits (/mm$^2$) |
|---|---|---|---|---|---|---|---|
| Ex. 1 | 21.7 | 677 | 589 | 0.4 | 75 | 15 | 7700 |
| Ex. 2 | 20.6 | 637 | 554 | 0.4 | 76 | 15 | 5000 |
| Ex. 3 | 16.4 | 652 | 587 | 0.6 | 89 | 18 | 2100 |
| Ex. 4 | 23.9 | 676 | 587 | 0.6 | 64 | 13 | 7800 |
| Ex. 5 | 23.6 | 664 | 601 | 0.6 | 67 | 13 | 8800 |
| Ex. 6 | 20.6 | 682 | 633 | 0.4 | 80 | 16 | 600 |
| Ex. 7 | 19.5 | 680 | 630 | 0.4 | 75 | 15 | 600 |

TABLE 3-continued

| | Conductivity (% IACS) | Tensile Strength (MPa) | 0.2% Proof Stress (MPa) | Bending Workability (R/t) | Stress Corrosion Cracking Resistance Time (h) | Stress Corrosion Cracking Resistance Ratio to 2600 | Number of Coarse Deposits (/mm$^2$) |
|---|---|---|---|---|---|---|---|
| Ex. 8 | 27.9 | 655 | 590 | 0.4 | 75 | 15 | 7500 |
| Ex. 9 | 18.5 | 685 | 590 | 0.6 | 128 | 26 | 7000 |
| Ex. 10 | 19.2 | 644 | 585 | 0.6 | 87 | 17 | 7600 |
| Ex. 11 | 22.0 | 735 | 660 | 0.6 | 65 | 13 | 7700 |
| Ex. 12 | 21.7 | 677 | 583 | 0.6 | 66 | 13 | 11000 |
| Ex. 13 | 23.4 | 651 | 601 | 0.6 | 75 | 15 | 7200 |
| Ex. 14 | 23.5 | 655 | 598 | 0.6 | 74 | 15 | 6900 |
| Ex. 15 | 24.0 | 653 | 600 | 0.6 | 72 | 14 | 8000 |
| Ex. 16 | 22.1 | 658 | 595 | 0.6 | 75 | 15 | 7800 |
| Comp. 1 | 25.3 | 659 | 593 | 0.8 | 24 | 5 | — |
| Comp. 2 | 24.8 | 660 | 589 | 0.8 | 25 | 5 | — |
| Comp. 3 | 19.5 | 650 | 583 | 0.8 | 39 | 8 | 20600 |
| Comp. 4 | 21.6 | 650 | 583 | 0.8 | 37 | 7 | 21000 |
| Comp. 5 | 18.2 | 652 | 596 | 0.8 | 30 | 6 | — |
| Comp. 6 | 16.2 | 642 | 584 | 0.8 | 25 | 5 | — |
| Comp. 7 | 19.5 | 675 | 625 | 0.8 | 30 | 6 | 16000 |
| Comp. 8 | 19.5 | 678 | 623 | 0.8 | 24 | 5 | 17800 |

The invention claimed is:

1. A sheet material of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities, wherein a period of time until cracks are observed in the sheet material at a magnification of 100 by means of an optical microscope is not shorter than 50 hours, while the sheet material, to which a bending stress corresponding to 80% of a 0.2% proof stress thereof is applied, is held at 25° C. in a desiccator containing 3% by weight of ammonia water, and wherein the number of coarse deposits, which have particle diameters of not less than 1 μm, per a unit area on the surface of said sheet material of the copper alloy is in the range of from 600/mm$^2$ to 15000/mm$^2$.

2. A sheet material of a copper alloy as set forth in claim 1, which has a tensile strength of not lower than 550 MPa.

3. A sheet material of a copper alloy as set forth in claim 1, which has a 0.2% proof stress of not lower than 500 MPa.

4. A sheet material of a copper alloy as set forth in claim 1, which has an electric conductivity of not lower than 10% IACS.

5. A sheet material of a copper alloy as set forth in claim 1, wherein said chemical composition of the sheet material of the copper alloy further comprises one or more elements which are selected from the group consisting of iron, cobalt, chromium, magnesium, aluminum, boron, phosphorus, zirconium, titanium, manganese, gold, silver, lead, cadmium and beryllium, the total amount of these elements being 3% by weight or less.

6. A sheet material of a copper alloy as set forth in claim 1, wherein the mean crystal grain size on the surface of said sheet material of the copper alloy is not greater than 10 μm.

7. A sheet material of a copper alloy as set forth in claim 1, wherein said period of time is not shorter than 60 hours.

8. A method for producing a sheet material of a copper alloy as set forth in claim 5, the method comprising the steps of:

melting and casting raw materials of a copper alloy which has a chemical composition comprising 17 to 32% by weight of zinc, 0.1 to 4.5% by weight of tin, 0.01 to 2.0% by weight of silicon, 0.01 to 5.0% by weight of nickel, and the balance being copper and unavoidable impurities;

hot-rolling the cast copper alloy in a temperature range of from 900° C. to 400° C.;

cooling the hot-rolled copper alloy at a cooling rate of 1 to 15° C./minute from 400° C. to 300° C.;

cold-rolling the cooled copper alloy;

recrystallization-annealing the cold-rolled copper alloy at a temperature of 300 to 800° C.; and ageing-annealing the recrystallization-annealed copper alloy at a temperature of 300 to 600° C.

9. A method for producing a sheet material of a copper alloy as set forth in claim 8, which further comprises steps of:

carrying out a finish cold-rolling after the step of ageing-annealing, and thereafter, carrying out a low-temperature annealing at a temperature of not higher than 450° C.

10. A method for producing a sheet material of a copper alloy as set forth in claim 8, which further comprises a step of carrying out a cold rolling after the step of recrystallization-annealing and before the step of ageing-annealing.

11. A method for producing a sheet material of a copper alloy as set forth in claim 8, wherein said chemical composition of the raw material of the copper alloy further comprises one or more elements which are selected from the group consisting of iron, cobalt, chromium, magnesium, aluminum, boron, phosphorus, zirconium, titanium, manganese, gold, silver, lead, cadmium and beryllium, the total amount of these elements being 3% by weight or less.

12. A connector terminal, the material of which is a sheet material of a copper alloy as set forth in claim 1.

* * * * *